US005360189A

United States Patent [19]

Hart

[11] Patent Number: 5,360,189

[45] Date of Patent: Nov. 1, 1994

[54] OUTDOOR BAG HOLDER

[76] Inventor: Casey Hart, 160 Grandview Street, Winnipeg, Manitoba, Canada, R2G 0L3

[21] Appl. No.: 894,603

[22] Filed: Jun. 5, 1992

[51] Int. Cl.[5] ..... B65B 67/12

[52] U.S. Cl. ..... 248/97; 248/99; 248/150; 248/156

[58] Field of Search ..... 248/95, 97, 99, 146, 248/156, 150; 108/125, 128, 130, 134

[56] References Cited

U.S. PATENT DOCUMENTS

| | | | |
|---|---|---|---|
| 812,157 | 2/1906 | Thompson | 248/97 X |
| 1,984,602 | 12/1934 | Snyder | 108/134 X |
| 3,532,314 | 10/1970 | Vosbikian | 248/97 |
| 3,679,160 | 7/1972 | Ballenger | 248/97 |
| 3,773,286 | 11/1973 | Govoni et al. | 248/97 |
| 4,069,993 | 1/1978 | Shanks | 248/97 |
| 4,312,489 | 1/1982 | Paetzold | 248/97 |
| 4,319,726 | 3/1982 | Andersson | 248/97 |
| 4,448,380 | 5/1984 | Huber-Krattiger | 108/125 X |
| 5,014,944 | 5/1991 | Malik et al. | 108/97 X |
| 5,139,219 | 8/1992 | Navarro et al. | 248/97 |

*Primary Examiner*—David A. Scherbel
*Assistant Examiner*—Derek J. Berger
*Attorney, Agent, or Firm*—Shawn Olfman

[57] ABSTRACT

An outdoor bag holder is made up of a rigid bag supporting member ("rbsm") that has a multiple of corners, two legs that are rotateably attached to the back of the rbsm, a U-shaped support arm, and a resting plate. The U-shaped support arm is rotateably attached to two sides of the rbsm. The resting plate is attached between the two legs, at a height such that when the U-shaped arm is supported by the resting plate, the rbsm is held perpendicular to the two legs. The dimensions of rbsm are chosen, such that when a bag of the type and size for which it was designed, has its mouth folded over the rbsm, the bag will be held open, and in place, by the tension between it, and the rbsm. The rods are of a shape and diameter, to allow them to be inserted into the ground, and are long enough, so that they can be inserted sufficiently far into the ground, so that the bag holder is held up, and at the same time, leave sufficient clearance between the rbsm, and the ground, for the bag for which it was designed.

6 Claims, 2 Drawing Sheets

OUTDOOR BAG HOLDER

BACKGROUND OF THE INVENTION

1. Field of the Invention

This invention relates generally to the field of bag holding devices, and in particular to the field of outdoor garbage bag holders.

2. Description of Related Art

There are a large number of different devices that have been invented for the purpose of holding garbage bags open. The known garbage bag holders can be categorized in many different ways. To enable the instant invention to be best understood, the most useful way to categorize garbage bag holders are as follows: (i) indoor simple; (ii) indoor complex; (iii) outdoor simple; (iv) outdoor complex.

A simple indoor garbage bag holder is illustrated by U.S. Pat. No. 4,319,726, issued to Gustav V. Andersson. It consists of a pole, a hoop shaped bottom member that fits onto the bottom of the pole, and a circular hoop which fits over the top of the pole, which hoop has a clamping device as a part of it. The bag fits over the top hoop and is clamped to the top hoop by the clamping device. An example of an indoor complex bag holder can be found in Canadian Patent No. 195,619, issued to John L. Wettlaufer. It consists of a four footed base, which supports a rod, which has a mechanical bag holding device slidably fitted over it.

Andersson's invention is also a good example of a simple outdoor bag holder, when the hoop base is replaced by a pointed end that is insertable into the ground. A complex outdoor bag holder can be seen in U.S. Pat. No. 4,069,993, issued to Donald L. Shanks. Shank's bag holder has a rectangular base, two stakes, each of which slides through a central aperture at opposite sides on the base, a rectangular support frame, which is attached to the top of the two stakes, and separate elements that are necessary to hold a bag to the support frame.

The four examples cited above are only a partial list of the patents that have been issued on bag holders. In the known art, inventors seeking to simplify bag holders have tended to eliminate legs. There are a large number of one-legged bag holders that have been invented. Like a one-legged man, they can stand-up, however, they cannot stand up as well as a two legged man. A common element in many of the known bag holders is a clamping or holding means for keeping the bag on the bag holder. That element is necessary as many previously invented bag holders were designed to hold a variety of different types of bags. Some bag holders were designed to hold cloth bags, paper bags, and plastic bags. Some bag holders were designed to hold bags of different sizes. Some were designed to hold bags of different materials and bags of different sizes.

The complex bag holders generally involve a multiple of different types of components, some of which are complex. They also generally rely on three or four legs, or a platform type of base to support the bag holder. Complex bag holders also employ clamping or gripping means to hold the bags to the bag holder. They seem to be designed to stand up securely and to hold their bag securely. However, as stated, they are relatively complex to build, therefore, relatively expensive. They can also usually accommodate a variety of different size bags and bags made out of different materials.

SUMMARY OF THE INVENTION

An object of the instant invention is to provide an outdoor bag holder that will strongly resist being knocked over or blown over. A second object of this invention is to provide an outdoor bag holder onto which a specific size of bag can be securely placed without the use of any type of clamping or holding device or means. A third object is to provide an outdoor bag holder that can fold essentially flat, for storage, when it is not being used. A fourth object is to provide an outdoor bag holder that need not have any detachable parts, and therefore no parts that can be lost. A fifth object is to provide an outdoor bag holder that can be opened for use, or closed for storage, without having to undo or do up, clamps, screws, or the like. A sixth object is to provide an outdoor bag holder that meets the previously stated objects and is also inexpensive and simple to construct.

To accomplish all of the above objects an outdoor bag holder of the instant invention is comprised of the following elements: a rigid bag supporting member that has at least four corners; two rigid legs, which are rotateably attached to the back of the rigid bag supporting member in such a manner that they may be rotated to both depend approximately vertically downward from the rigid bag supporting member in such a relation to it that they can support it, when they are inserted into the ground, and also such that they may be rotated to lie in a plane approximately parallel to the plane defined by the rigid bag supporting member; a resting plate, attached at an intermediate point, to the two rigid legs; a U-shaped arm, that has one of its open ends rotatably attached to one side of the rigid bag supporting member, and the other of its open ends rotatably attached to the other side of the rigid bag supporting member; wherein the U-shaped arm is of a length, such that when the bottom of the U-shaped arm is resting on the resting plate, the U-shaped arm will be holding the rigid bag supporting member approximately perpendicular to the two rigid legs; wherein the dimensions of the rigid bag supporting member are such that when a bag of the type and size for which it was designed, has its mouth folded over the rigid bag supporting member, the bag will be held open, and in place, by the tension between it and the rigid bag supporting member; and wherein the two rigid legs are of a cross-sectional shape and measurement that allows them to be inserted into the ground, and they are long enough so that they can be inserted sufficiently far into the ground so that the bag holder is held up, and at the same time leave sufficient clearance between the rigid bag supporting member and the ground, for the bag for which the outdoor bag holder was designed.

To use the instant invention a person pushes the bottom ends of the legs sufficiently far into the ground to hold up the outdoor bag holder and then places the bottom of the U-shaped arm, to rest on the resting plate, by doing that, the rigid bag supporting member is held approximately parallel to the ground. The result is that the outdoor bag holder is securely held upright by the ground into which its legs have been pushed, and the rigid bag supporting member is held roughly parallel to the ground, a sufficient height above the ground for the size of bag it was designed to be used with. The mouth of the bag is then folded over the rigid bag supporting member, and thereby held open above the ground. After whatever was sought to be placed in the bag, has been placed in the bag, the bag's mouth is slid downwardly off of the rigid bag supporting member and the bag is removed. The legs are pulled out of the ground and the rigid bag supporting member is folded flat against the two legs, and then stored as desired.

It can be seen that each of the objects listed above have been met. Because the two legs can be inserted a sufficient distance into the ground, the invented outdoor bag holder will strongly resist being knocked over or blown over. Neither a clamping device nor any type of holding device or means is needed to hold the bag onto the bag supporting member. The tension between the folded open mouth of the bag and the rigid bag supporting member it is folded around, is sufficient to hold the bag in place and open. The invention can fold essentially flat, for storage, when it is not being used. The instant invention need not have any detachable parts. The rigid bag supporting member simply rotates about the legs, therefore the invention can be opened for use, or closed for storage, without having to undo or do up, clamps, screws, or the like. The instant invention can be made from only two rods, a rectangular bag supporting member, a U-shaped arm, and a flat metal plate therefore it is inexpensive and simple to construct.

DESCRIPTION OF THE PREFERRED EMBODIMENT

Figure 1:
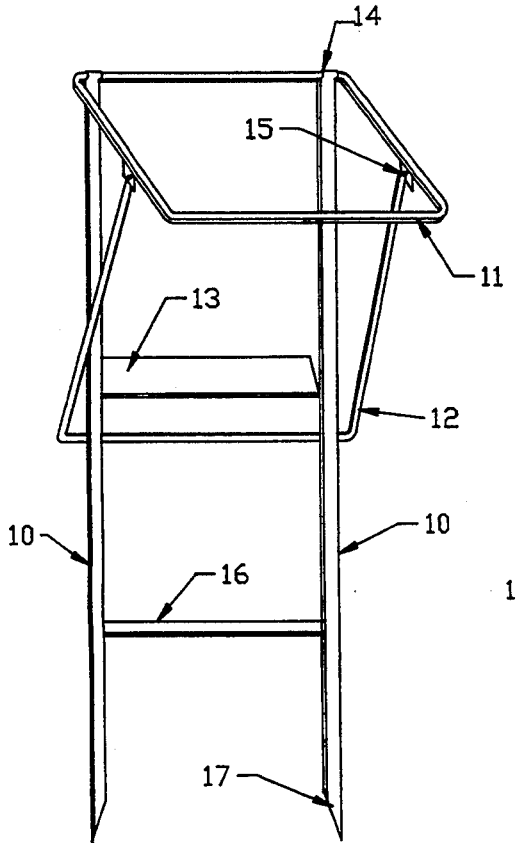
FIG. 1 is a perspective view of a preferred embodiment of the invention that is not yet fully open.

FIG. 1 illustrates a preferred embodiment of the invention, which is either being opened or closed, but is not yet fully open or fully closed. The preferred embodiment shown in FIG. 1 is comprised of two rods 10, a rigid rectangular bag supporting member 11 (hereinafter referred to as "rrbsm"), a lower cross rod 16, a middle cross plate 13, a square-"U" shaped support 12 (hereinafter referred to as the "support"), and two flanges 15. The two rods 10, each have a pointed bottom end 17, and a looped top end 14. Each of loops 14 can be formed in any suitable way. For example, a loop 14 could be formed by curving the top end of a rod 10 downwardly and back toward rod 10, at a point on rod 10 near the top end of rod 10. Alternatively, a loop 14 could be made by permanently attaching a rigid washer to the top of a rod 10. The back side of the rrbsm 11 is within each of loops 14. The rrbsm 11 is tubular and has a cross sectional diameter less than the interior diameter of a loop 14. Therefore the rrbsm can rotate within the loops 14.

A bag holder of the instant invention, including the bag holder illustrated in the preferred embodiment, is designed to hold a specific type of bag, of a specific size, it is not designed to hold any type of bag of any size. The circumference of the rrbsm is chosen to be small enough to allow the mouth of the bag it was designed to hold to be folded over it, and at the same time large enough so that when the mouth of the bag, it was designed to hold, is folded over it, sufficient tension will exist between the folded over mouth of the bag and the rrbsm to hold the bag open and in place.

The rods 10 of the preferred embodiment have a sufficient height such that when they are inserted into the ground far enough to securely hold the bag holder upright, the distance between the ground and the bottoms of the loops 14 will be approximately equal to the height of a fully open bag of the size that the bag holder was designed to hold.

One of flanges 15 is permanently attached to one of the sides of the rrbsm 11 that runs perpendicular to the back of the rrbsm. The other of flanges 15 is permanently attached to the other of the sides of the rrbsm 11 that runs perpendicular to the back of the rrbsm. Each of flanges 15 are attached approximately centrally and such that it depends downwardly at a right angle to the side it is attached to. Each flange 15 has a central aperture. Support 12 is tubular and has a cross sectional diameter less than the diameter of the central aperture in a flange 15. Each of the ends of each of the sides of support 12 is disposed outwardly at a right angle to the side of which it is the end, thereby forming an end portion on each of the sides of support 12 that is outwardly perpendicular to the side of which it is the end. One of the end portions of a side of support 12 is rotateably inserted into one of the apertures in one of the flanges 15. The other of the end portions of the other side of support 12 is rotateably inserted into the aperture in the other of the two flanges 15. In the preferred embodiment illustrated in FIG. 1 the outward perpendicular end portions of support 12 are inserted into the apertures in the flanges 15 such that they extend outwardly of the rrbsm.

Figure 2:
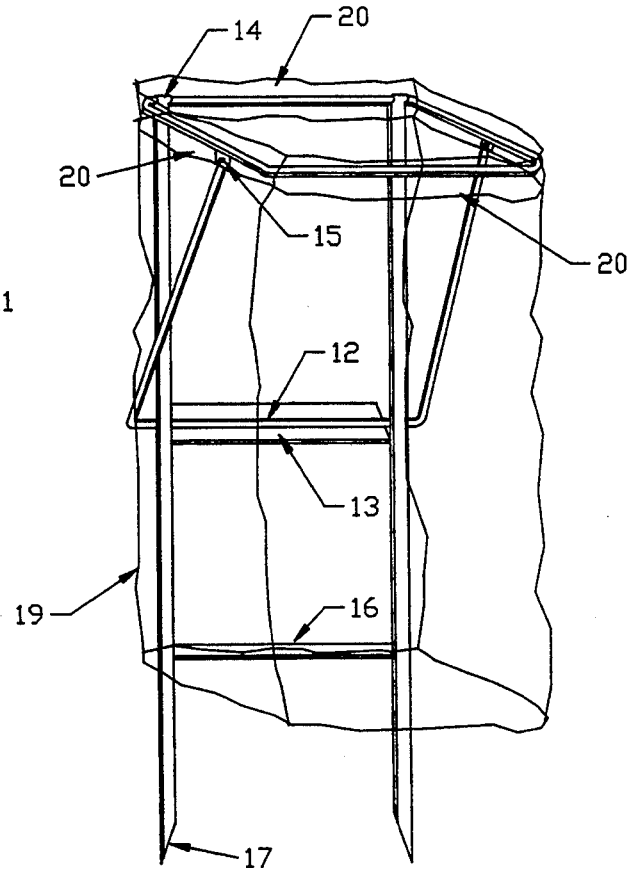
FIG. 2 is a perspective view of a preferred embodiment of the invention in the open position, holding a see through plastic bag.
Figure 3:
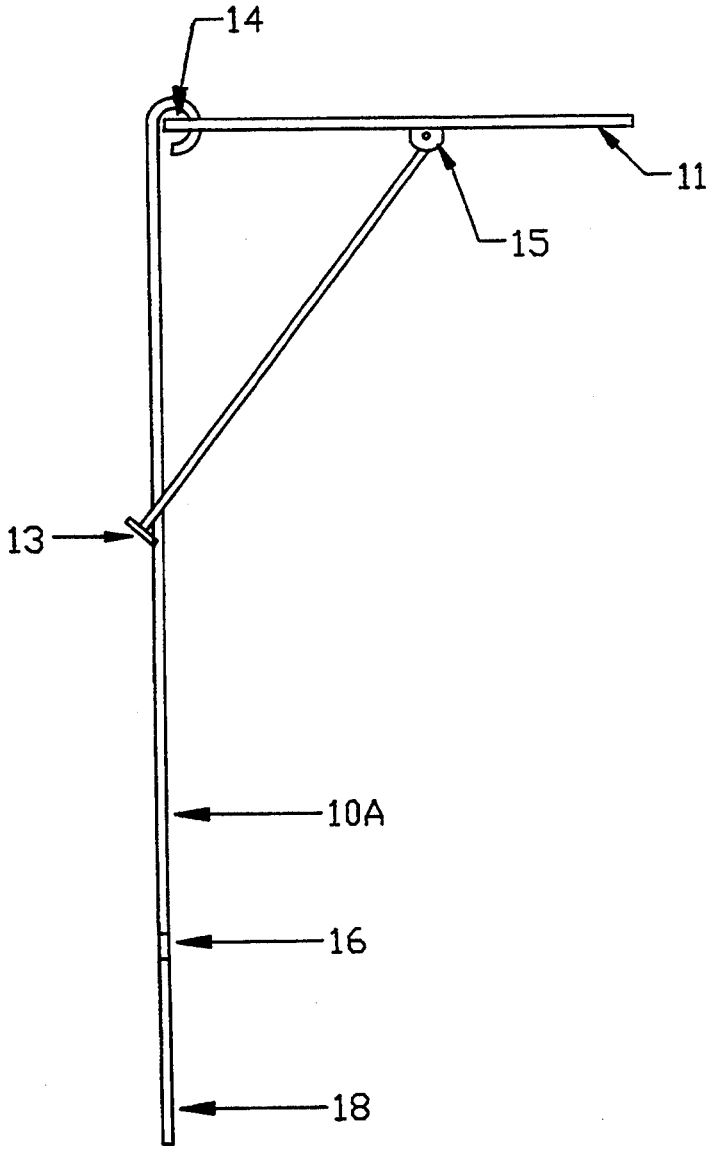
FIG. 3 is a side view of a preferred embodiment of the invention in the open position.

The middle cross plate 13 is permanently attached between the rods 10 such that it's top portion forms an angle of less than 90 degrees with the backs of rods 10. In the preferred embodiment the angle is between 15 degrees and 45 degrees. The middle cross plate 13 is located at a distance below the tops of rods 10 such that when the bottom of the support 12 is held between then middle cross plate 13 and the rods 10, the rrbsm is held at an approximate 90 degree angle to the rods 10. FIG. 2 illustrates the preferred embodiment of the invention in the open position with the support 12 held between the middle cross plate 13 and the rods 10.

To use the preferred embodiment illustrated in FIGS. 1 and 2, a person steps the bottom ends of the rods 10 sufficiently far into the ground, by holding the invention to the ground and stepping on lower cross rod 16. The user then lifts the rrbsm 11 until the support 12 slides into the space between the middle cross plate 13 and the rods 10. The user then places the bag's mouth inside the open rrbsm and folds the top of the bag's mouth back over the rrbsm, as at 20 in FIG. 2. The mouth of the bag is thereby held open above the ground. After whatever was sought to be placed in the bag has been placed in the bag, the folded over portions of the bag's mouth are slid downwardly off of the rrbsm and the bag is removed. The rods are pulled out of the ground, the rrbsm is lifted to cause the support 12 to disengage from between the middle cross plate 13 and the rods 10, and the bag holder may then be folded flat for storage.

The support 12 does not have to be designed exactly as shown in FIGS. 1 and 2. Any design that would allow it to support the rrbsm at an approximate 90 degree angle to the rods 10, would work. For another example, the support 12 could be made up of two independent "L"-shaped arms.

The preferred embodiment is made entirely of metal, with the flanges 15, and the middle cross plate 13, and the lower cross rod 16, all being welded in place. However, the invention does not have to be made of metal, any rigid material could be used, for example a rigid plastic could be used.

The bottoms of rods 10 do not have to be pointed, as they are at 17. Ending the rods 10 in a point assists in their insertion in the ground, however, because of the small diameters that would be used for rods 10, they would be insertable even if they were not pointed.

The rods 10, the support 12, the lower cross rod 16, and the rrbsm, do not have to have circular cross-sections, circular cross-sections are recommended, but not essential. If, for example, a triangular cross-section is used, as long as the apertures in flanges 15 and in loops 14 are large enough to permit rotation of the support, and of the rrbsm, respectively, the invention will operate as desired.

Lower cross rod 16 provides two advantages to the preferred embodiment. Firstly, it provides extra support for rods 10. Secondly, it allows for easier insertion of rods 10 into the ground. The user simple holds the rods 10 near their top ends and steps on lower cross rod 16 to insert the bottom ends of rods 10 into the ground.

The rigid bag supporting member does not have to be rectangular. It has to have a minimum of four corners, as it is the corners that holdingly engage the mouth of the bag. A square, pentagonal, hexagonal, or any four or more cornered shape is suitable. In the preferred embodiment a rectangle is used. However, whatever shape is used, the rigid bag supporting member must have a circumference small enough to allow the mouth of the bag it was designed to hold, to fit over it, and large enough so that when the mouth of the bag is folded over it, sufficient tension will exist between the folded over mouth of the bag and the rigid bag supporting member to hold the bag open and in place.

The outdoor bag holder does not have to be supported on rods. Rods are the recommended legs, however, any two legs that would function may be used. For example, elongated wooden stakes, having a square cross-section, could be used. If elongated wooden stakes were used in the FIGS. 1 and 2 embodiment, the loops 14 could be made of "eye" bolts screwed into the top ends of the wooden legs, and middle cross plate 13, and cross rod 16, could be attached to the legs in any of the usual ways in which wood and metal are joined.

There can be many variations of materials, and means of permanently attaching the elements that have to be permanently attached, all of which are within this invention and the following claims. The variations that have not been specifically set out herein are those that would be obvious to a person skilled in the art.

I claim:

1. An outdoor bag holder, comprised of:

(i) a rigid, multi-cornered, bag supporting member having a front, a back and two sides;

(ii) two rigid rods, the tops of which are rotatably attached to the back of the bag supporting member;

(iii) a "U"-shaped support, rotateably attached, at one of its ends, to a first side of the bag supporting member, and rotateably attached, at the other of its ends, to a second side of the bag supporting member;

(iv) a resting plate, permanently attached to the two rigid rods, between and perpendicular to the two rigid rods, at a distance from the tops of the two rigid rods, such that when the "U"-shaped support is held by it, the bag supporting member is held at an approximate 90 degree angle to the two rigid rods;

(v) wherein the dimensions of the bag supporting member are such that, when a bag, of the size that the outdoor bag holder was designed to hold, has its mouth folded over the bag supporting member, the bag will be held to the bag supporting member by the tension between its folded over mouth and the bag supporting member;

(vi) and wherein the rigid rods are of a cross-sectional measurement, such that they can be inserted into the ground, and of a height, such that they can be inserted sufficiently far into the ground, so that said insertion securely holds the outdoor bag holder upright, and that there is sufficient clearance between the bag supporting member and the ground, for the bag for which the outdoor bag holder was designed.

2. An outdoor bag holder, as described in claim 1, wherein each of the two rigid rods, has a pointed bottom end.

3. An outdoor bag holder, as described in claim 1, wherein the bag supporting member is in the shape of a rectangle.

4. An outdoor bag holder, as described in claim 1, that is also comprised of a rigid arm, that is permanently attached to the two rigid rods, between them, at a height above the bottoms of the two rigid rods, greater than the minimum distance that the two rigid rods would normally be inserted into the ground, to hold up the outdoor bag.

5. An outdoor bag holder, as described in claim 1, that is also comprised of a rigid arm, that is permanently attached to the two rigid rods, between them, at a height above the bottoms of the two rigid rods, greater than the minimum distance that the two rigid rods would normally be inserted into the ground, to hold up the outdoor bag; and wherein the bag supporting member is in the shape of a rectangle.

6. An outdoor bag holder, as described in claim 1, that is also comprised of a rigid arm, that is permanently attached to the two rigid rods, between them, at a height above the bottoms of the two rigid rods, greater than the minimum distance that the two rigid rods would normally be inserted into the ground, to hold up the outdoor bag; and wherein the bag supporting member is in the shape of a rectangle; and wherein each of the two rigid rods, has a pointed bottom end.

* * * * *